United States Patent [19]

Kusz

[11] Patent Number: 4,997,096

[45] Date of Patent: Mar. 5, 1991

[54] CHILD RESISTANT CLOSURES

[75] Inventor: Maximillian Kusz, Waterville, Ohio

[73] Assignee: Owens-Illinois Closure, Inc., Toledo, Ohio

[21] Appl. No.: 515,887

[22] Filed: Apr. 27, 1990

[51] Int. Cl.[5] ..... B65D 55/02

[52] U.S. Cl. ..... 215/201; 215/220

[58] Field of Search ..... 215/201, 204, 208, 217, 215/218, 219, 220

[56] References Cited

U.S. PATENT DOCUMENTS

| | | | |
|---|---|---|---|
| 3,705,662 | 12/1972 | Gach | 215/220 |
| 3,926,326 | 12/1975 | Grau | 215/218 |
| 3,944,102 | 3/1976 | Grau | 215/217 X |
| 4,319,690 | 3/1982 | Birrell et al. | 215/220 |
| 4,609,114 | 9/1986 | Roy | 215/220 |
| 4,673,095 | 6/1987 | Puresevic et al. | 215/220 |
| 4,854,459 | 8/1989 | DeJonge | 215/219 X |

*Primary Examiner*—Stephen Marcus
*Assistant Examiner*—Vanessa M. Roberts

[57] ABSTRACT

A child resistant closure comprising an outer shell having a base wall and a peripheral skirt and an inner shell having a base wall and a peripheral skirt telescoped within the outer shell. The inner surface of the base wall of the outer shell and the outer surface of the base wall of the inner shell have circumferentially spaced radial projections which are adapted to interengage upon relative axial movement between the shells. The top wall of the inner shell includes indentations or grooves between the projections which are at a small acute angle with respect to the plane of the top wall of the inner shell. The inner surface of the outer shell has at least one inclined indentation or surface which extends radially and is also at an acute angle to the plane of the base wall of the outer shell. When the outer shell is tilted in the direction of the inclined surface, the lugs projecting from the area of the inclined surface of the base wall of the outer shell engage the grooves in the outer surface of the base wall of the inner shell allowing the inner shell to be unscrewed from the container on which the closure is provided. The closure can be also operated by moving the outer shell axially toward the inner shell to engage the projections on the outer shell and inner shell.

9 Claims, 3 Drawing Sheets

CHILD RESISTANT CLOSURES

This invention relates to child resistant closures.

BACKGROUND OF THE INVENTION

In one common type of child resistant closure, such as shown in British Patent No. 1,529,999, the closure comprises an outer shell having a base wall and a peripheral skirt and an inner shell having a base wall and a peripheral skirt telescoped within the outer shell. The inner shell has threads on the inner surface thereof adapted to engage the threads on a container. The outer shell has a series of radial projections on the base wall thereof which are adapted to engage projections on the outer surface of the inner shell upon relative axial movement between the shell. Each projection on one of the shells has a first surface for transmitting rotational movement for threading the closure on the container and a second cam surface such that the outer shell will rotate relative to the inner shell when rotated to unthread the closure unless the outer shell is moved axially with force toward the inner shell. One of the problems with such a closure is that substantial axial force is required to engage the projections and rotate the closure to unscrew the closure from the container. The amount of axial load that must be used is directly dependent upon the rotational torque in inch pounds that must be exerted to remove the closure. The greater the force which has been used to tighten the closure on the container, the greater the axial load required to remove the closure. Otherwise, the projections or lugs on the inside of the outer shell will cam over the projections or lugs on the inner shell. Accordingly, the closure may not be user friendly.

SUMMARY OF THE INVENTION

Among the objectives of the present invention are to provide a child resistant closure of the aforementioned type which is more user friendly; wherein the amount of axial force required to remove the closure is not solely dependent upon the interengagement of the sides of the projections to provide the desired break-away torque necessary to loosen the closure; and wherein the closure can be removed either by a tilting of the outer shell relative to the inner shell or by axial movement only of the outer shell relative to the inner shell.

In accordance with the invention, a child resistant closure comprises an outer shell having a base wall and a peripheral skirt and an inner shell having a base wall and a peripheral skirt telescoped within the outer shell. The inner surface of the base wall of the outer shell and the outer surface of the base wall of the inner shell have circumferentially spaced radial projections which are adapted to interengage upon relative axial movement between the shells. The top wall of the inner shell includes indentations or grooves between the projections which are at a small acute angle with respect to the plane of the top wall of the inner shell. The inner surface of the outer shell has at least one indentation or surface which extends radially and is also at an acute angle to the plane of the base wall of the outer shell. When the outer shell is tilted in the direction of the inclined surface of the outer shell, the lugs projecting from the area of the inclined surface of the base wall of the outer shell engage the grooves in the outer surface of the base wall of the inner shell allowing the inner shell to be unscrewed from the container on which the closure is provided. The closure can be also operated by moving the outer shell axially toward the inner shell to interengage the projections on the outer shell and inner shell.

DESCRIPTION OF THE PREFERRED EMBODIMENT

Figure 5:
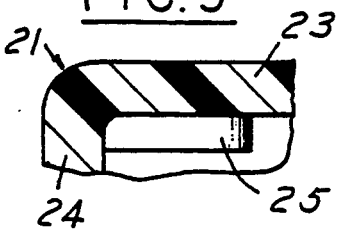
FIG. 5 is a fragmentary sectional view on an enlarged scale taken along the line 5—5 in FIG. 4.
Figure 6:
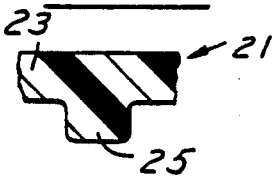
FIG. 6 is a fragmentary sectional view taken along the line 6—6 in FIG. 4.
Figure 1:
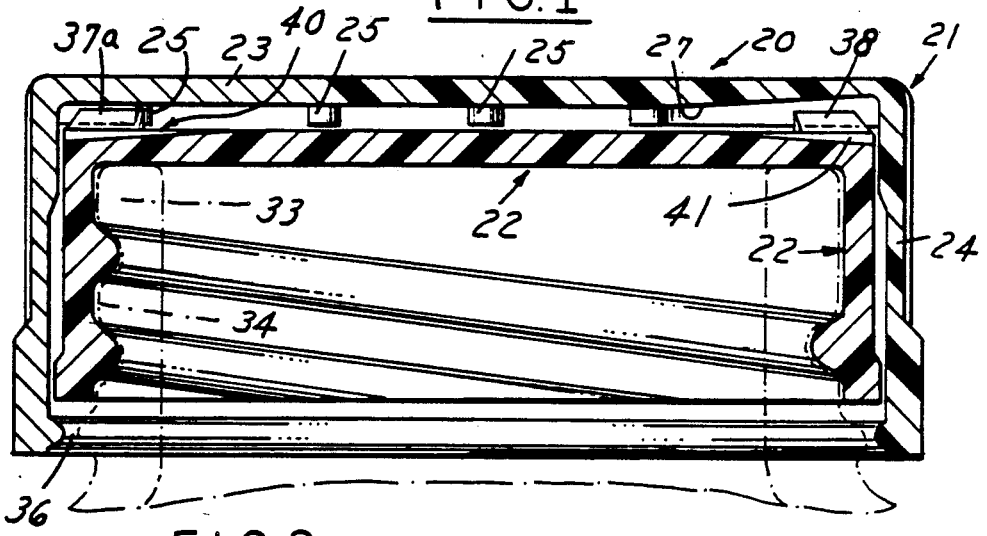
FIG. 1 is a vertical sectional view of a child resistant closure embodying the invention.
Figure 4:
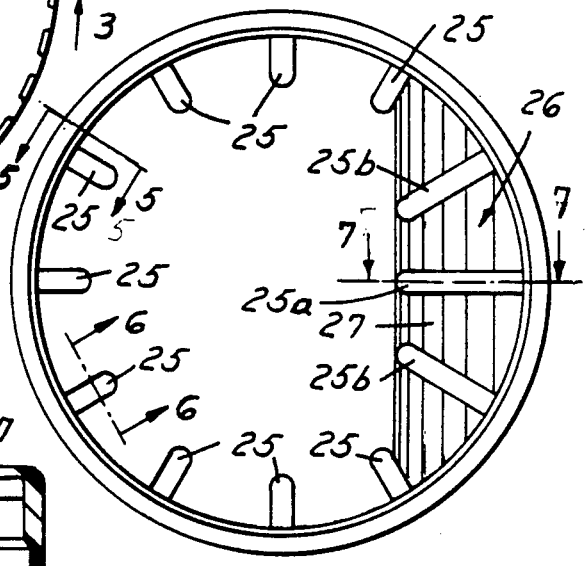
FIG. 4 is a bottom plan view of the outer shell of the closure.
Figure 3:
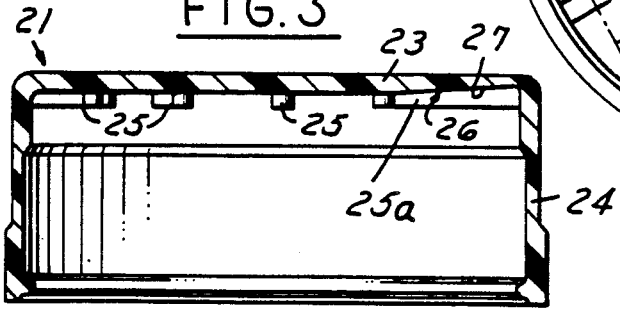
FIG. 3 is a sectional view taken along the line 3—3 in FIG. 2.

Referring to FIG. 1, the child resistant closure 20 comprises an outer shell 21 and an inner shell 22 telescoped within the outer shell. The outer shell 21 includes a base wall 23 and a peripheral skirt 24. The base wall includes circumferentially spaced radial projections 25 (FIGS. 4–6). The projections 25 extend radially inwardly from the area of juncture of the base wall 23 and skirt 24 and have their inner ends spaced radially from the center of the shell 21. Projections 25 have planar side surfaces **25*a* extending axially or perpendicular to the plane of the top wall of the outer shell 21. Outer shell 21 further includes an indentation 26 defining an inclined surface 27 that extends radially and forms an acute angle, on the order of 3.5 degrees with respect to the plane of the base wall 23. As shown in FIG. 4, the inclined surface 27 comprises a planar chordal surface that spans a plurality of projections 25 which in the chordal area have a greater length as at 25*a* and 25*b***.

Figure 7:
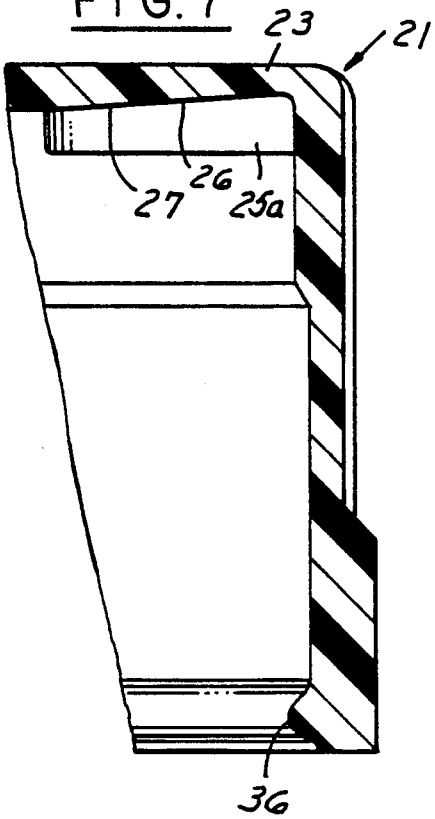
FIG. 7 is a fragmentary sectional view on an enlarged scale taken along the line 7—7 in FIG. 4.
Figure 8:
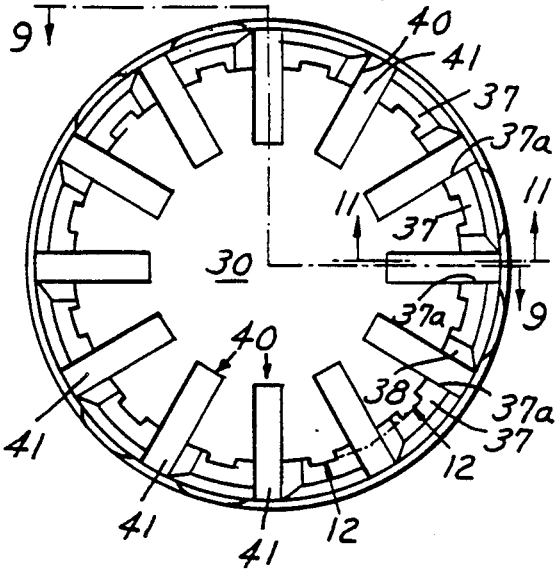
FIG. 8 is a top plan view of the inner shell.
Figure 9:
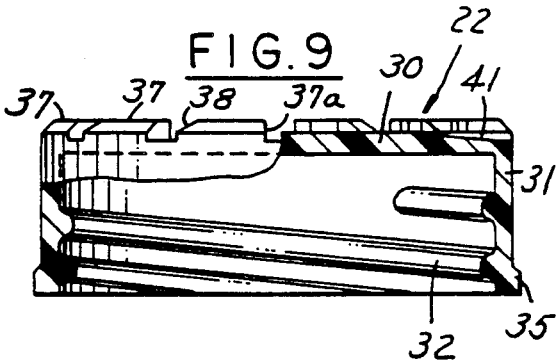
FIG. 9 is a part sectional view taken along the line 9—9 in FIG. 8.
Figure 10:
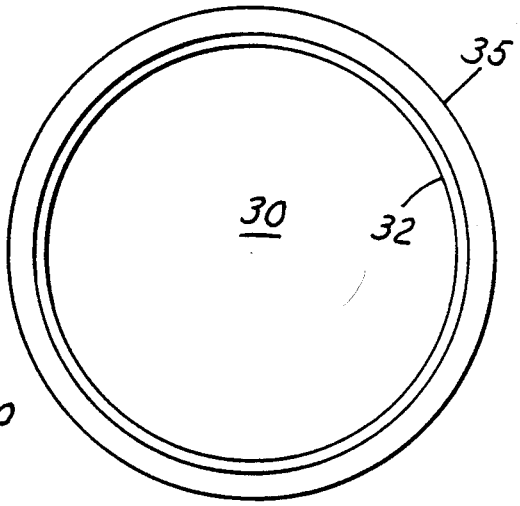
FIG. 10 is a bottom plan view of the inner shell.
Figure 11:
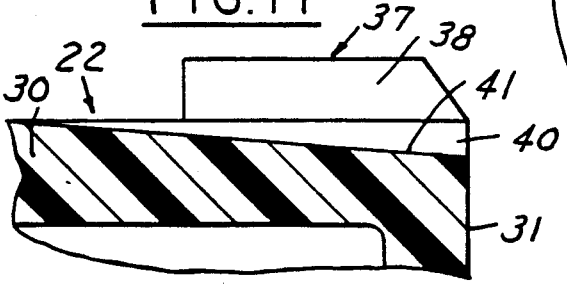
FIG. 11 is a fragmentary sectional view taken along the line 11—11 in FIG. 8.

Referring to FIGS. 8–11, the inner shell 22 includes a base wall 30 and a peripheral skirt 31 which in turn has threads 32 on the inner surface thereof for engaging the threads 33 on a container 34. The skirt 31 further includes a radial flange 35 adapted to engage beneath a bead 36 on the lower end of the skirt 24 of the outer shell 21 (FIGS. 1, 7).

The base wall 30 of the inner shell 22 includes a plurality of circumferentially spaced radial projections or lugs 37 that extend from the area of juncture of the base wall 30 and skirt 31 radially inwardly and have their ends spaced from the axis of the shell 22. Each projection 37 includes a radial and axial surface 37*a* which is adapted to be engaged by the projections 25 on the outer shell 21 when the closure is threaded on the container. Each projection 37 also includes a radially inclined cam surface 38 which is adapted to be engaged by the projections 25 on the outer shell 21 during the unthreading of the closure in the event that insufficient axial force is applied to provide engagement between the projections 25 and the projections 37. The outer shell and inner shell are preferably made of plastic material such as polypropylene.

The aforementioned construction is old and well known as disclosed in the aforementioned British Patent No. 1,529,999, incorporated herein by reference, except for the inclined indentation 26 and associated surface 27 on the outer shell and the addition of a plurality of circumferentially spaced grooves 40 on the inner shell 22. The grooves 40 extend radially and are spaced between the projections 37 to define an inclined base surface 41 that forms an acute angle with the plane of the base wall 30 of the shell 22, preferably in the order of about 3.5 degrees with respect to the plane of the base wall. Each groove 40 also has a planar axial side surface 42 which is an extension of the axial surface 37*a* on the adjacent lug 37 and an opposite planar axial side surface 43.

By this arrangement, the closure is applied to the container in the normal fashion and during the application an axial load is applied by appropriate machinery to cause the outer shell 21 to move axially toward the inner shell engaging the projections 25 on the outer shell with the surfaces 37*a* of projections 37 on the inner shell to tighten the closure onto the container. If a child or the like were thereafter to rotate the outer shell 21 in the direction to unthread the closure from the container, the cam surfaces 38 would normally cam the outer shell away from the inner shell preventing engagement of the projections.

Figure 2:
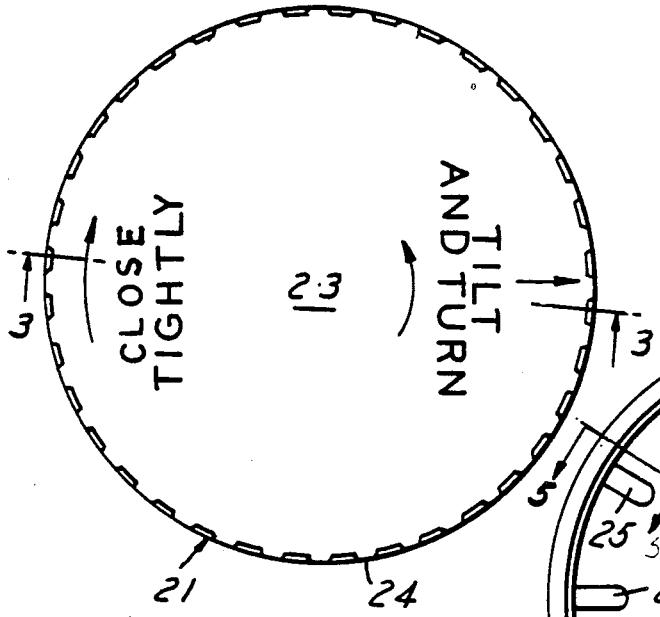
FIG. 2 is a plan view of the outer shell of the closure.

In accordance with the invention, a downward force to a portion of the periphery of the outer shell will cause the projections 25*a*, 25*b* on the outer shell 21 to engage the grooves 40 on the inner shell 22 allowing torque to be transmitted from the outer shell 21 to the inner shell 22 so that the closure can be removed. To facilitate operation, suitable markings or indicia are applied to the outer surface of the base wall indicating to the user the location where a downward force should be applied, as shown in FIG. 2.

Applying downward force in this location will cause the outer closure 21 to tilt with respect to the inner closure 22. This will allow one or more projections 25 from the inside top of the outer closure 21 located below the top plane of the inner closure 22, and into inclined area 41 where the perpendicular face of the projection 25 can contact the surface 42 generally perpendicular to the top plane of the closure. Because there is contact between surfaces on the outer closure 21 and inner closure 22 that are generally parallel to each other and to the vertical axis of the closure, torque can be transmitted directly from the outer closure 21 to the inner closure 22.

Applying downward force uniformly to the top of the outer closure 21 or at any other location than that indicated as being above the inclined surface area, will require the user to exert sufficient downward pressure to overcome the tendency for the projections on the inside top of the outer to cam over the inclined surface 38 of the lugs 37 on top of the inner closure 22.

Figure 12:
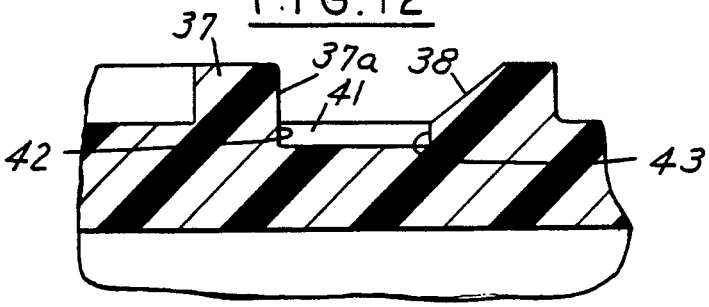
FIG. 12 is a fragmentary sectional view on an enlarged scale taken along the line 12—12 in FIG. 8.
Figure 13:
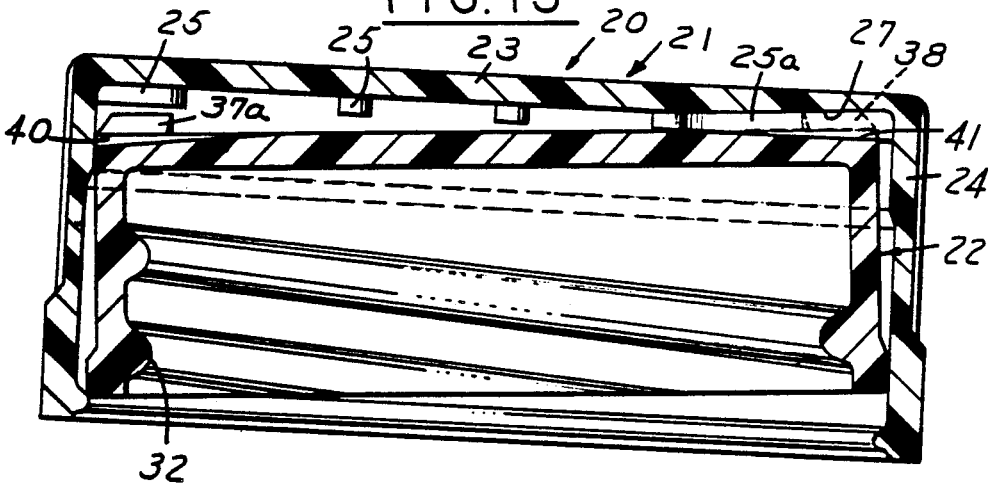
FIG. 13 is a sectional view similar to FIG. 1 showing the relative position of the parts when the closure is to be removed from the container.
Figure 14:
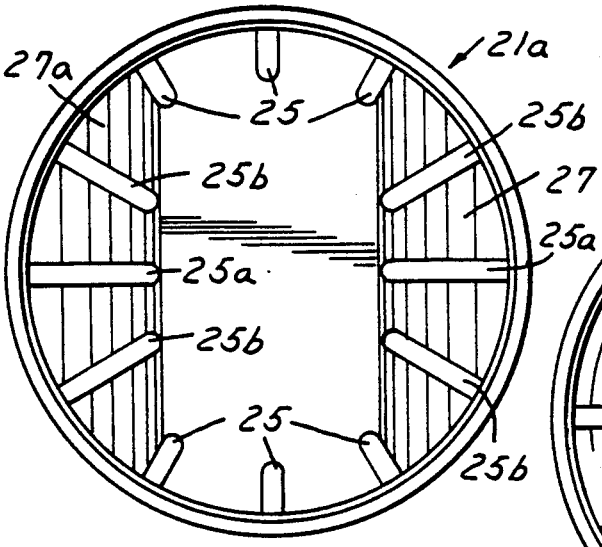
FIG. 14 is a bottom plan view of a modified form of outer shell.

In the form of outer shell shown in FIG. 14, a second planar and chordal surface 27*a* is provided on the outer shell 21*a* so that the closure can be tilted at two positions.

Figure 15:
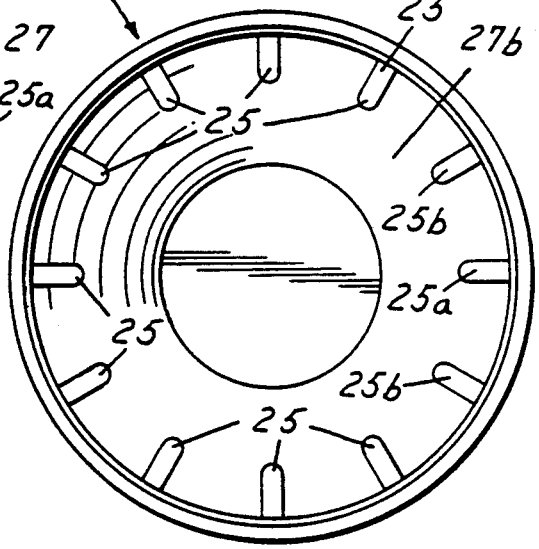
FIG. 15 is a bottom plan view of a further modified form of shell.

In the form shown in FIG. 15, the outer shell 21*b* includes an inclined surface 27*b* between each projection 25, all the surfaces 27*b* lying in a common frustoconical surface. Thus, in this form, the outer shell 21*b* can be tilted at any position.

In both of the forms shown in FIGS. 14 and 15, the inner shell 22 remains the same.

It can thus be seen that there has been provided a child resistant closure of the aforementioned type which is more user friendly; wherein the amount of axial force required to remove the closure is not solely dependent upon the interengagement of the sides of the projections to provide the desired break-away torque necessary to loosen the closure; and wherein the closure can be removed either by a tilting of the outer shell relative to the inner shell or by axial movement only of the outer shell relative to the inner shell.

What is claimed is:

1. A child resistant closure comprising an outer shell having a base wall and a peripheral skirt, an inner shell having a base wall and a peripheral skirt telescoped within the outer shell, the inner surface of the base wall of the outer shell and the outer surface of the base wall of the inner shell having projections which are adapted to interengage upon relative axial movement between the shells, the projections on the inner shell having a first surface which is interengaged by the projections on the outer shell for threading the closure on a container and a second inclined cam surface such that the outer shell will rotate relative to the inner shell when rotated to unthread the closure unless the outer shell is moved axially with sufficient force toward the inner shell, the top wall of the inner shell including inclined grooves between the projections on the inner shell which are at a small acute angle with respect to the plane of the top wall of the inner shell, the inner surface of the outer shell has at least one inclined surface which extends radially and is also at an acute angle to the plane of the base wall of the outer shell, such that when the outer shell is tilted in the direction of the inclined surface, the lugs projecting from the inside surface of the base wall of the outer shell engage the grooves in the outer surface of the base wall of the inner shell allowing the inner shell to be unscrewed from the container on which the closure is provided, and such that the closure can be also operated by moving the outer shell axially with sufficient force toward the inner shell to engage the projections.

2. The child resistant closure set forth in claim 1 wherein said inclined surface on said outer shell comprises a planar chordal surface.

3. The child resistant closure set forth in claim 2 wherein said chordal inclined surface subtends a plurality of projections on said outer shell.

4. The child resistant closure set forth in claim 3 wherein said projections on said chordal surface are longer than the remaining projections on the outer shell.

5. The child resistant closure set forth in any one of claims 1–4 including a plurality of said inclined surfaces on said outer shell.

6. The child resistant closure set forth in claim 1 wherein an inclined surface is provided between adjacent projections on said outer shell.

7. The child resistant closure set forth in claim 6 wherein said inclined surfaces lie in a common frustoconical surface.

8. The child resistant closure set forth in any one of claims 1–4 wherein said acute angles of the grooves on the inner shell and inclined surface on the outer shell are substantially equal.

9. The child resistant closure set forth in any one of claims 1–4 wherein said base surface of the grooves on the inner shell and the inclined surface on the outer shell form acute angles of about 3.5°.

* * * * *